US006731901B2

(12) United States Patent
Nishitani et al.

(10) Patent No.: US 6,731,901 B2
(45) Date of Patent: May 4, 2004

(54) IMAGE HEATING APPARATUS

(75) Inventors: Hitoshi Nishitani, Ibaraki (JP); Naoki Nakamura, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 10/091,283

(22) Filed: Mar. 6, 2002

(65) Prior Publication Data

US 2002/0141796 A1 Oct. 3, 2002

(30) Foreign Application Priority Data

Mar. 9, 2001 (JP) ..... 2001-067157

(51) Int. Cl.[7] ..... G03G 15/20
(52) U.S. Cl. ..... 399/329; 219/216
(58) Field of Search ..... 399/122, 320, 399/329, 330, 331; 219/216; 100/155 R, 168, 171, 176

(56) References Cited

U.S. PATENT DOCUMENTS

| | | | | | |
|---|---|---|---|---|---|
| 4,802,439 | A | * | 2/1989 | Sugimoto et al. | 118/116 |
| 5,148,226 | A | | 9/1992 | Setoriyama et al. | |
| 5,149,941 | A | | 9/1992 | Hirabayashi et al. | 219/216 |
| 5,179,415 | A | * | 1/1993 | Ikematsu et al. | 399/331 |
| 5,525,775 | A | | 6/1996 | Setoriyama et al. | 219/216 |
| 5,532,806 | A | * | 7/1996 | Sugita et al. | 399/328 |
| 5,708,926 | A | * | 1/1998 | Sagara et al. | 399/122 |
| 5,742,878 | A | * | 4/1998 | Kuroda | 399/122 |
| 5,810,965 | A | * | 9/1998 | Fwu | 156/359 |

FOREIGN PATENT DOCUMENTS

| | | | | |
|---|---|---|---|---|
| JP | 63-313182 | | 12/1988 | |
| JP | 4-44075 | | 2/1992 | |
| JP | 4-44077 | | 2/1992 | |
| JP | 08328406 | A * | 12/1996 | G03G/15/20 |
| JP | 09212019 | A * | 8/1997 | G03G/15/20 |
| JP | 10171276 | A * | 6/1998 | G03G/15/20 |

* cited by examiner

*Primary Examiner*—Robert Beatty
(74) *Attorney, Agent, or Firm*—Fitzpatrick, Cella, Harper & Scinto

(57) ABSTRACT

An image heating apparatus includes a heater; a film sliding on the heater, a roller forming a nip with the heater with the film being put between the roller and the heater, the nip nipping and conveying a recording material bearing an image thereon with the image on the recording material being heated by heat from the heater through the film, an elastic member for pressing the heater to a side of the roller, a pressing member for pressing an end portion of the elastic member on a side thereof opposed to a side of the heater, and a supporting portion for supporting the pressing member, the supporting portion including an opening portion through which the elastic member can pass.

13 Claims, 9 Drawing Sheets

IMAGE HEATING APPARATUS

BACKGROUND OF THE INVENTION

1. Field of the Invention

The present invention relates to an image heating apparatus of an image forming apparatus, which uses an electrophotographic process, such as a copying machine, a laser printer, a facsimile and the like.

2. Related Background Art

Recently, a fixing apparatus has adopted a film heating process. The film heating process, as it is disclosed in Japanese Patent Application Laid-Open No. 63-313182, first produces a heater by forming a pattern of a heating body on a ceramic substrate, and then heats a body to be heated by making the heater generate heat through a cylindrically formed thin film placed between the heater and the body to be heated.

If an endless belt-like film is used in such a film heating process, a large approaching force is produced on the film. As a measure to the approaching force, a method disclosed in Japanese Patent Application Laid-Open Nos. 4-44075 and 4-44077 has been put to practical use. In the method, the film is wound loosely and driven for the reduction of the approaching force of the film and for the decrease of the driving torque therefor.

FIG. 7 shows the configuration of the pressurizing portion of An image heating apparatus being related art of the present invention. In FIG. 7, a reference numeral 101 designates a heat-proof film; a reference numeral 103 designates a heater holding member; and a reference numeral 104 designates a metal stay. A reference numeral 127 designates a compression spring, and a reference numeral 105 designates a pressurizing force transmitting member, which is made of a resin member and is provided with a pressurizing portion 105*a*. The lower end portion of the compression spring 127 touches the top surface of the pressurizing portion 105*a*. A reference numeral 106 designates a pressure roller, and a reference numeral 128 designates a spring pressing member, which the upper end portion of the compression spring 127 touches. A reference numeral 131 designates a pressure roller supporting member having a notch portion. The upper portion of the notch portion is formed to be an opening. A pressure roller bearing 132 for supporting the pressure roller 106 by the shaft thereof is fitted to the lower portion of the notch portion.

As shown in FIG. 7, the heat fixing apparatus is configured to make it possible to press a heater 102 (see FIG. 8) against the pressure roller 106 by pressurizing the pressuring portion 105*a* of the pressuring force transmitting member 105 to the pressure roller 106 with the compression spring 127, with the metal stay 104 and the heater holding member 103 being put between the pressuring portion 105*a* and the heater 102.

The spring pressing member 128 has the function of pressing the upper end of the compression spring 127. However, if the spring pressing member 128 only satisfied the function, the spring pressing member 128 might integrally be formed with the pressure roller supporting member 131.

However, if the pressure roller supporting member 131 and the spring pressing member 128 were integrally formed, the pressurizing force transmitting member 105 could not inserted into the pressure roller supporting member 131 from the direction of an arrow A shown in FIG. 7 when the pressurizing force transmitting member 105 would be incorporated into the pressure roller supporting member 131. Besides, when the compression spring 127 would be assembled, the compression spring 127 should be inserted from aside into the space formed by the integrally configured pressure roller supporting member 131 and the spring pressing member 128 while the compression spring 127 should be being compressed. Accordingly, for avoiding such problems concerning the operability of assembling, the pressure roller supporting member 131 and the spring pressing member 128 are formed as separate parts such that the compressing spring 127 and the spring pressing member 128 can be assembled from the direction of the arrow A shown in FIG. 7 after the pressurizing force transmitting member 105 has been incorporated into the pressure roller supporting member 131.

Moreover, it is general that a projection (a paring or a drawing having a height of a degree of the thickness of a sheet metal) is formed on each of the spring pressing member 128 and the pressurizing force transmitting member 105 for locating the compression spring 127.

However, the heat fixing apparatus shown in FIG. 7 has the following problems.

A first problem is the inferior efficiency of the assembling of the spring pressing member 128. The pressurizing force of the compression spring 127 is generally 10 kg or more. And it seems to be inevitable to improve the thermal efficiency of the heat fixing apparatus in consideration of the recent demand of the market of increasing the printing speed of a laser printer and of improving the fixing property thereof. Consequently, the pressurizing force has the tendency of being increasing furthermore afterwards.

Moreover, the spring pressing member 128 is generally incorporated into the pressure roller supporting member 131 as follows. That is, one method is, as shown in FIG. 8A, to fit one end side of the spring pressing member 128 to the pressure roller supporting member 131, and then to rotate the other end side of the spring pressing member 128 against the spring force of the compression spring 127 around the fitted end side thereof while incorporating the spring pressing member 128 to the pressure roller supporting member 131. Another method is, as shown in FIG. 8B, to slide the spring pressing member 128 against the spring force of the compression spring 127 while incorporating the spring pressing member 128 in the pressure roller supporting member 131. The largeness of the spring load exceeding 5 kg on one side is a factor making the operability at the assembling of the spring pressing member 128 worse.

A second problem of the heat fixing apparatus shown in FIG. 7 concerns the spring constant of the compression spring 127. That is, the spring constant cannot be made to be large owing to the assembling method thereof described above.

It is needless to say that the spring constant of the compression spring 127 is desirable to be as small as possible for attaining the stable pressurizing force of the compression spring 127 to make the fixing property of the heat fixing apparatus stable from consideration of the hardness of the pressure roller 106, the load of the compression spring 127, and the dispersion of the accuracy of the dimensions of each part at the mass production thereof.

However, if the spring constant is made too small, the free length of the spring before the assembling thereof becomes long as a result. Thereby, the compression spring 127 is buckled in the assembling process thereof. Consequently, the problem concerning the inferiority of the assembling efficiency is further promoted.

Moreover, the loss of the spring force of the compression spring 127 owing to the buckling thereof frequently becomes a problem when the free length thereof becomes long as a result of the reduction of the spring constant. FIG. 9A shows the situation. Generally, it is said that the loss of the spring force is easily produced when the rate of the free length of a compression spring to the winding diameter thereof exceeds four. Consequently, the free length is normally set within the range of the condition of the rate, and the minimum spring constant is generally determined on the basis of the set free length.

A method for decreasing the loss of the spring force owing to the buckling, as shown in FIG. 9B, provides a guide bar 128*a* in the inner diameter portion of the compression spring 127 to prevent the buckling thereof. However, in the case where the compression spring 127 and the spring pressing member 128 are rotated or slid while being incorporated in the pressure roller supporting member 131 as shown in FIG. 8A and FIG. 8B, it is impossible to provide the guide bar 128*a*. Consequently, in the heat fixing apparatus, the pressurizing portion of which is assembled by a method shown in FIG. 8A or FIG. 8B, the spring constant of the compression spring 127 could be made small within the range in which the loss of the spring force thereof owing to the buckling thereof was not produced.

A third problem of the heat fixing apparatus shown in FIG. 7 concerns the spring pressing member 128 being a metal part. Because the spring pressing member 128 supports a load exceeding 5 kg as described above, it is necessary that the bending rigidity of the spring pressing member 128 in the direction of an arrow B in FIG. 7 should be large. Consequently, it is essential that the material of the spring pressing member 128 in the shape shown in FIG. 7 should not be a resin but a metal. Hence, the metal spring pressing member 128 has the following problems. That is, the sizes of the parts thereof become large; the manufacturing cost thereof becomes high; the fixing means thereof is also need high rigidity; and such a guide bar as is shown in FIG. 9B is difficult to form.

SUMMARY OF THE INVENTION

An object of the present invention is to provide an image heating apparatus capable of improving the operability thereof at the assembling thereof.

Another object of the present invention is to provide an image heating apparatus including: a heater; a film sliding on the heater; a roller forming a nip with the heater with the film being put between the roller and the heater; an elastic member for pressing the heater to a side of the roller; a pressing member for pressing an end portion of the elastic member on a side thereof opposed to a side of the heater; and a supporting member for supporting the pressing member, wherein a recording material bearing an image thereon is nipped and conveyed at the nip with the image on the recording material being heated by heat from the heater through the film, and the supporting member has an opening portion through which the elastic member can pass.

A further object of the present invention will be clear in the following description.

DESCRIPTION OF THE PREFERRED EMBODIMENTS

Hereinafter, preferred embodiments of the present invention are described on the attached drawings.

Figure 5:
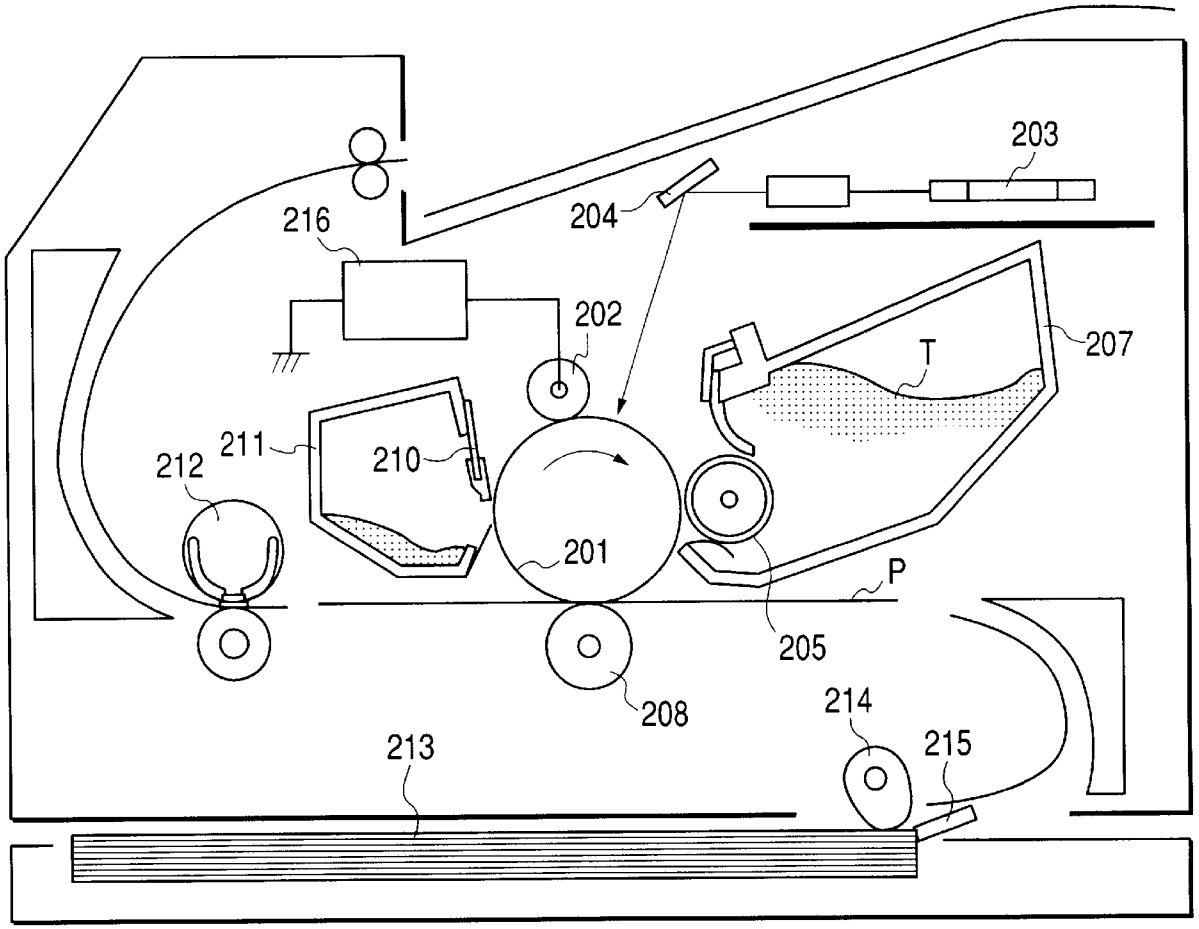
FIG. 5 is a schematic sectional view of an image forming apparatus to which an image heating apparatus of an example of the present invention.

FIG. 5 shows an image forming apparatus using an electrophotographic process to which an image heating apparatus of an example of the present invention is applied. In FIG. 5, a reference numeral 201 designates a photosensitive drum; a reference numeral 202 designates a charging roller; a reference numeral 203 designates a laser exposing apparatus; a reference numeral 204 designates a reflecting mirror; a reference numeral 205 designates a development sleeve; a reference character T designates toner; a reference numeral 207 designates a toner container; a reference numeral 208 designates a transferring roller; a reference character P designates a sheet being a recording material such as a sheet of paper; a reference numeral 210 designates a cleaning blade; a reference numeral 211 designates a waste toner container; a reference numeral 212 designates a fixing apparatus being the image heating apparatus; a reference numeral 213 designates a paper cassette; a reference numeral 214 designates a feed roller; a reference numeral 215 designates a separation pad; and a reference numeral 216 designates a high voltage power supply.

The photosensitive drum 201 rotates in the direction of an arrow. The surface of the photosensitive drum 201 is uniformly charged by the charging roller 202 to which a voltage is fed from the high voltage power supply 216. A laser beam emitted by the laser exposing apparatus 203 is reflected by the reflecting mirror 204 to irradiate the surface of the photosensitive drum 201. Thereby, an electrostatic latent image is formed on the surface of the photosensitive drum 201.

Toner T is filled in the toner container 207. By the rotation of the development sleeve 205, a proper quantity of the toner T is suitably charged. After that, the charged toner T is fed on the surface of the photosensitive drum 201. The toner T on the development sleeve 205 adheres to the electrostatic latent image on the surface of the photosensitive drum 201. Thereby, the latent image is developed to be visualized as a toner image.

The feed roller 214 feeds a sheet one by one from the paper cassette 213 at a suitable timing. The separation pad 215 is disposed to abut against the feed roller 214. The friction coefficient, the angle to the ground, and the shape of the surface of the separation pad 215 are adjusted to feed only one sheet at a time.

The visualized toner image on the surface of the photosensitive drum 201 is transferred on the sheet P by the transferring roller 208. The residual toner that has not been transferred to the sheet P and has remained on the surface of the photosensitive drum 201 is contained in the waste toner container 211 by the cleaning blade 210. The photosensitive drum 201, the surface of which has been cleaned, repeatedly enters into the next image forming process. Moreover, the sheet P, on which the unfixed toner image exists, is heated and pressurized by the fixing apparatus 212 being fixing means. Thereby, the unfixed toner image on the sheet P is eternally fixed on the sheet P.

Figure 6:
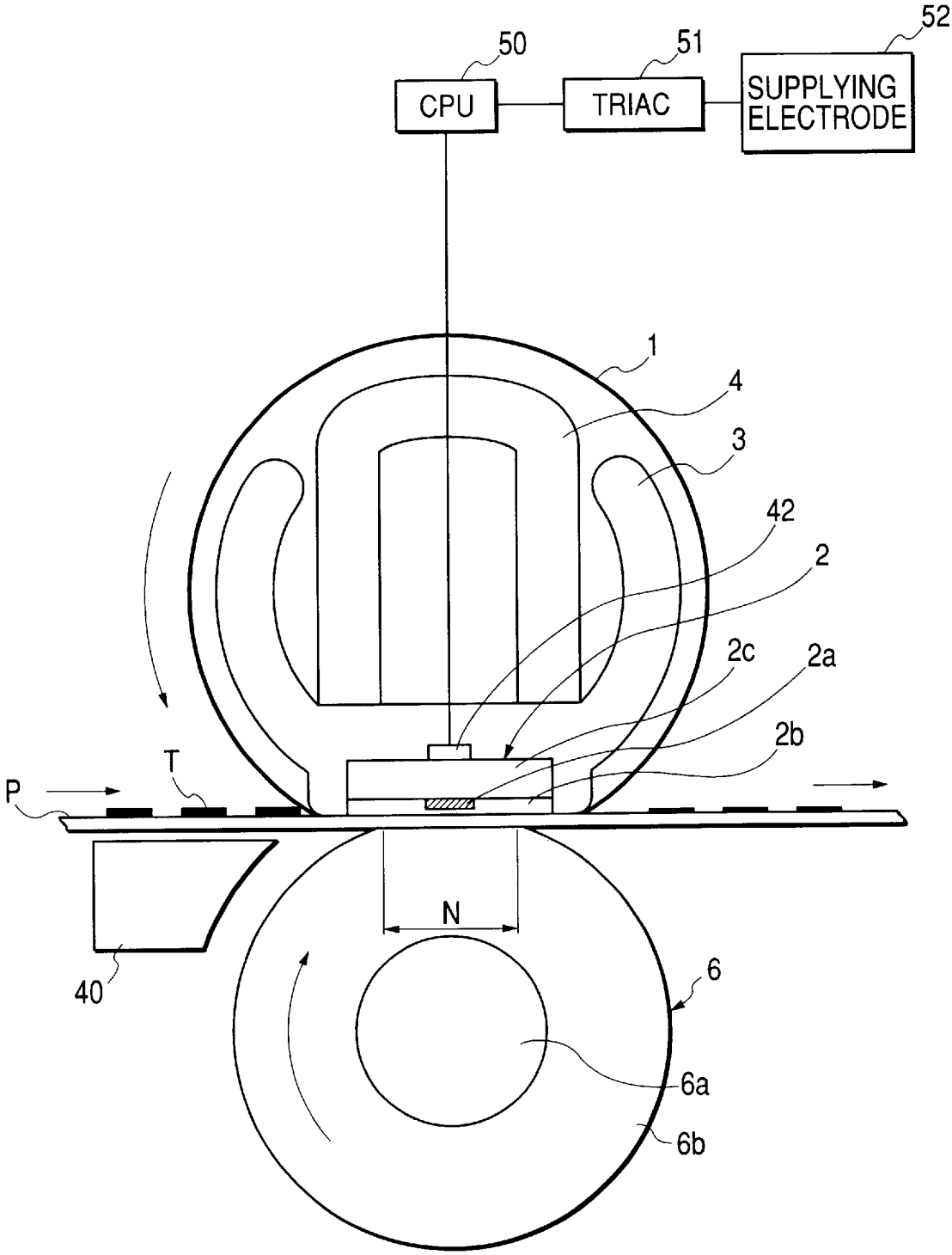
FIG. 6 is a schematic sectional view of an image heating apparatus being the example of the present invention.
Figure 7:
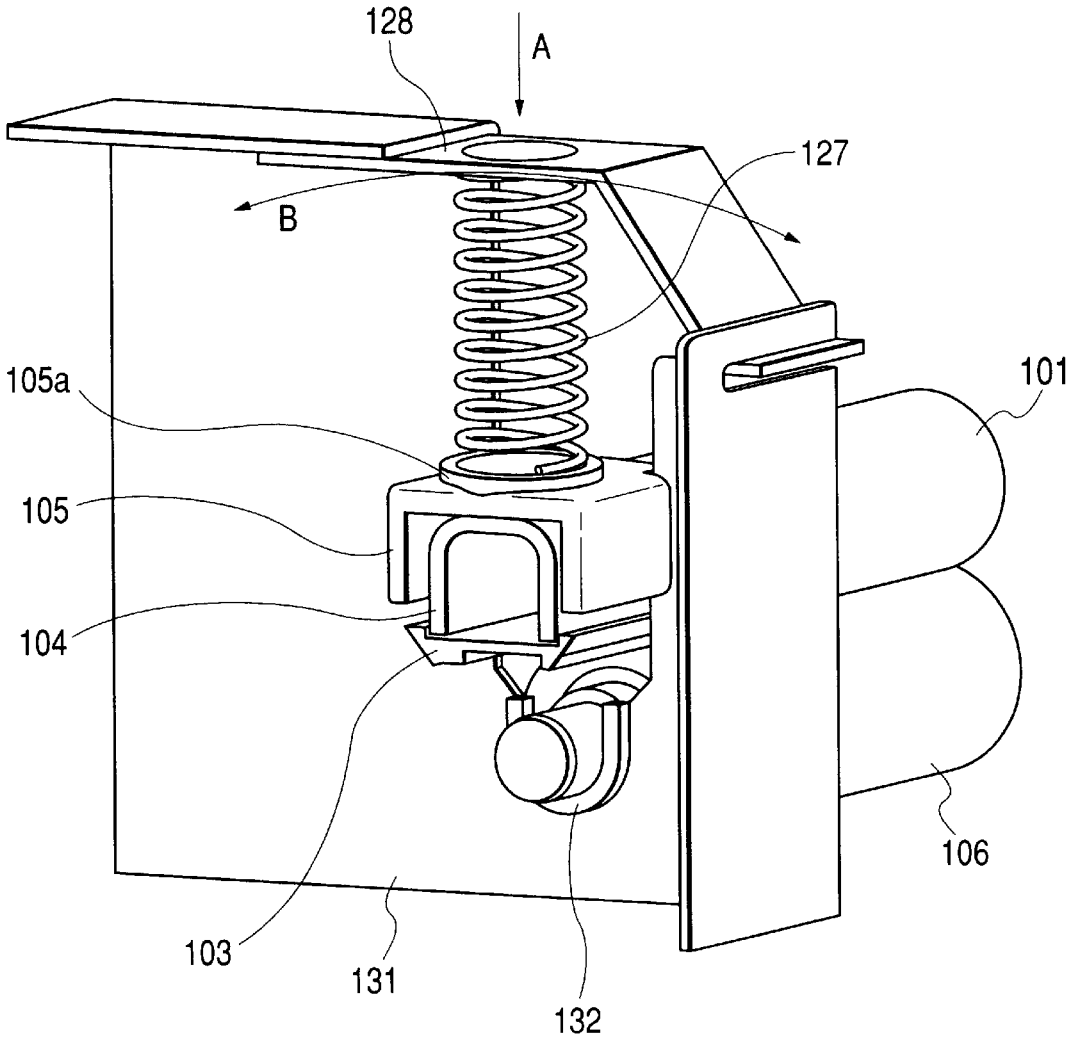
FIG. 7 is a perspective view showing the pressurizing portion of a heat fixing apparatus being the related art of the present invention.

FIG. 6 is a schematic sectional view of the image heating apparatus being the example of the present invention. In FIG. 6, a reference numeral 2 designates a heater. The heater 2 is composed of a ceramic substrate 2*c*, a heating body 2*a* formed on the ceramic substrate 2*c*, and a glass layer 2*b* coated on the heating body 2*a* as a protecting layer. A thermistor 42 is mounted on the back surface of the heater 2 to detect the temperature of the heater 2. The heating body 2*a* generates heat by being fed from a not shown power supply.

A central processing unit (CPU) 50 drives a triac 51 to regulate the temperature of the thermistor 42 to be constant. The quantity of fed electric power to the thermistor 42 through a supplying electrode 52 is controlled by the CPU 50.

A heat-proof film 1 is a film composed of cylindrical three layers. The innermost layer is a base layer. The base layer bears mechanical characteristics such as the torsional strength, the evenness of the heat-proof film 1. The base layer is made from a resin such as polyimide, polyamide-imide, poly etheretherketone (PEEK), poly ethersulfone (PES), poly phenylene sulfide (PPS), or the like. The next layer is a conductive primer layer. The conductive primer layer is a conductive layer in which conductive particles such as carbon black or the like are dispersed. The second layer also has a role as an adhesive for joining a third layer with the base layer. The outermost layer is a top layer. The top layer is designed to have the most suitable resistance value and thickness lest various image faults should be caused.

A reference numeral 3 designates a heater holding member. The heater holding member 3 supports the heater 2. The heater holding member 3 is molded with a heat-proof resin such as PPS, a liquid crystal polymer, or the like. The heater holding member 3 also has a role of a guide member for urging the smooth rotation of the heat-proof film 1. A reference numeral 4 designates a metal stay. The metal stay 4 is made from a metal such as iron, aluminum or the like. The metal stay 4 performs the role of suppressing the deformation of the heater holding member 3 caused by the creep thereof to heighten the rigidity thereof.

A reference numeral 6 designates a pressure roller. The pressure roller 6 is composed of a core metal 6*a* made from aluminum, iron or the like, and a heat-proof elastic body 6*b* such as silicon rubber. The elastic body 6*b* covers the core metal 6*a*. The surface layer of the pressure roller 6*a* is provided with a coating of a fluoride resin such as a perfluoroalkoxy (PFA) resin, a polytetra fluoroethylene (PTFE) resin, fluorinated ethylene propylene resin (FEP), or the like. Those resins have the releasability from toner.

The pressure roller 6 is pressed against the heater 2 with the heat-proof film 1 being put between the pressure roller 6 and the heater 2. A fixing nip portion N is formed at the pressing portion of the pressure roller 6 to the heater 2. The core metal 6*a* of the pressure roller 6 is driven to rotate, and then the heat-proof film 1 follows to the pressure roller 6 to rotate at the fixing nip portion N. A sheet P bearing an unfixed toner image thereon is conveyed by the transferring roller 208 and the photosensitive drum 201 to be guided into the fixing nip portion N by a fixing entrance guide 40. The toner T on the sheet P is pressed against the sheet P at the fixing nip portion N, and heated there. Then, the toner resin of the toner T is softened, and the toner T adheres closely to the sheet P. Thereby, the toner T is eternally fixed to the sheet P.

Because such a fixing apparatus using the film heating process can use a heater having a low heat capacity, it becomes possible to shorten the waiting time thereof (or quick starting) in comparison with a conventional fixing apparatus adopting a heat roller process. Moreover, because the quick starting becomes possible, preheating at a not printing operation becomes unnecessary, and the saving of electric power can totally be achieved.

Figure 1:
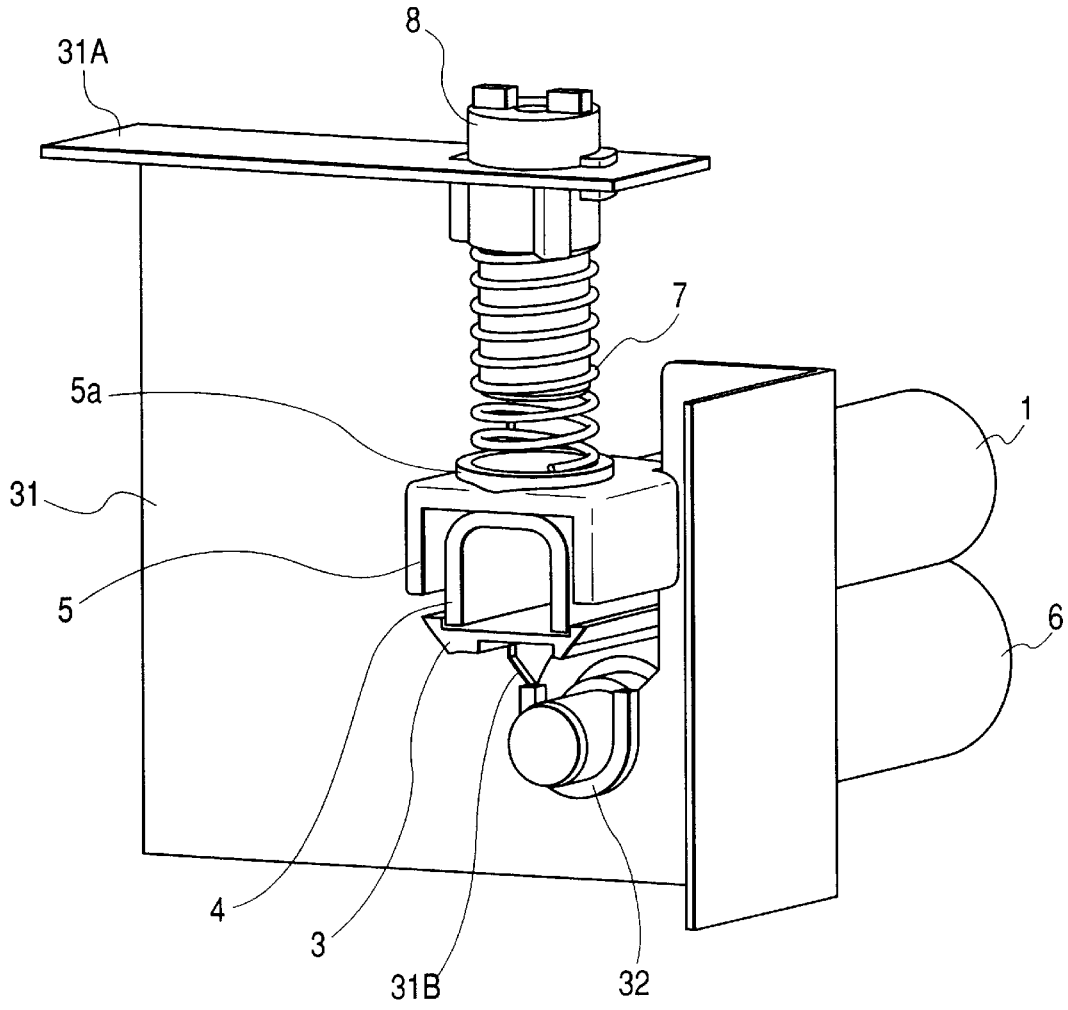
FIG. 1 is a perspective view showing the pressurizing portion of an image heating apparatus of a first embodiment of the present invention.

FIG. 1 shows a first embodiment of the present invention. FIG. 1 is a perspective view showing the pressuring portion of a heat fixing apparatus. Incidentally, although FIG. 1 shows the configuration of the pressurizing portion of the heat fixing apparatus on the end portion on one side thereof, the configuration of the pressurizing portion is provided on both the end portion sides (or both the end portion sides in a direction orthogonal to the conveying direction of the sheet 2) of the heat fixing apparatus, and both the end portions have similar configurations. Therefore, only the configuration of the pressurizing portion formed on one side is described in the following.

In FIG. 1, the reference numeral 1 designates the cylindrically formed heat-proof film; the reference numeral 3 designates the heater holding member; the reference numeral 4 designates the metal stay; a reference numeral 5 designates a pressurizing force transmitting member; a reference numeral 5*a* designates a pressuring portion; the reference numeral 6 designates the pressure roller; a reference numeral 7 designates a coil-shaped compression spring being an elastic member; a reference numeral 8 designates a spring pressing member for pressing the end portion of the compression spring 7 opposite to the heater side; a reference numeral 31 designates a pressure roller supporting member; and a reference numeral 32 designates a pressure roller bearing. In the present embodiment, the pressure roller bearing 32 is fitted into a notch portion 31B, which is formed in the pressure roller supporting member 31 and has an opening at the upper portion thereof. The heater holding member 3 is fitted to the notch portion 31B above the pressure roller bearing 32. And further, the pressurizing force transmitting member 5 is fitted into the notch portion 31B.

Although the heater 2 has the heating body 2*a* on one side surface (or the pressure roller side in the present embodiment) of the ceramic substrate 2*c*, the heating body 2*a* may be formed on the other surface of he ceramic substrate 2*c* or both the surfaces thereof.

As shown in FIG. 1, the heat fixing apparatus is configured to make it possible to press the heater 2 against the pressure roller 6 by pressurizing the pressuring portion 5*a* of the pressuring force transmitting member 5 to the pressure roller 6 with the compression spring 7, with the metal stay 4 and the heater holding member 3 being put between the pressuring portion 5*a* and the heater 2. The compression spring 7 is provided on a line connecting the heater 2 with the pressure roller 6.

The pressure roller supporting member 31 is provided with a flange portion 31A, which is a supporting portion, at the upper part thereof. A hole 31*a* (see FIG. 2A and FIG. 2B) being an opening portion, which is described later, is formed in the flange portion 31A. That is, the flange portion 31A is integrally formed with the pressure roller supporting member 31 in the heat fixing apparatus shown in FIG. 1.

Next, an assembling method of the compression spring 7 and the spring pressing member 8 supporting the upper end portion of the compression spring 7 and the characteristics of the assembling method are described.

Figure 2A:
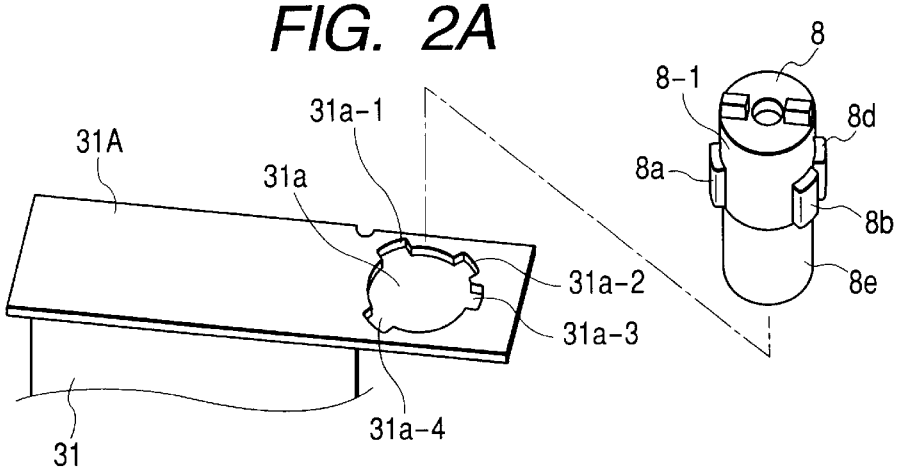
FIG. 2A and FIG. 2B are views showing relations between a spring pressing member in the pressurizing portion of FIG. 1 and a hole in a pressure roller supporting member.
Figure 2B:
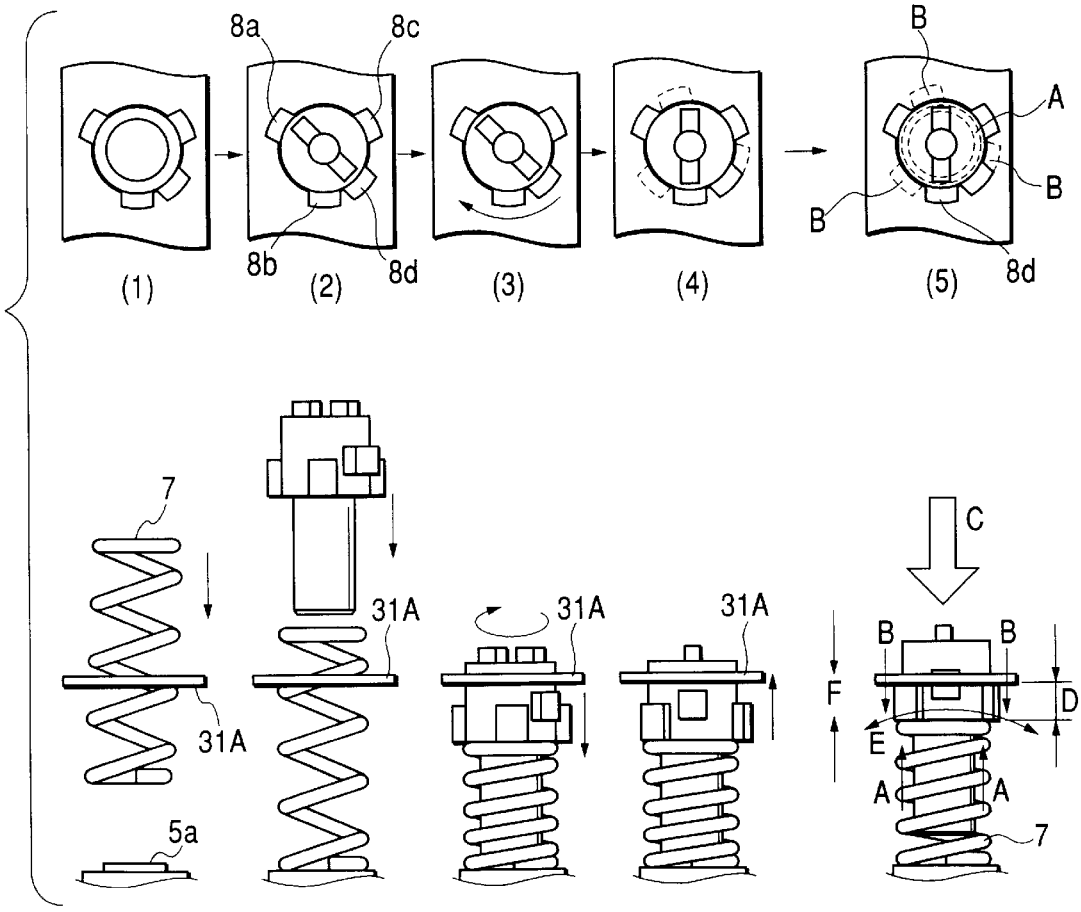

FIG. 2A shows a relation between the hole formed in the flange portion 31*a* of the pressure roller supporting member 31 and the spring pressing member 8, and FIG. 2B shows the assembling order of the pressure roller supporting member 31 and the spring pressing member 8.

A plurality of concavity portions 31*a*-1, 31*a*-2, 31*a*-3 and 31*a*-4 are formed with predetermined intervals to each other in the inner periphery portion of the hole 31*a*. Moreover, the spring pressing member 8 is formed in a bar with steps. Projection portions 8*a*, 8*b* and 8*c* being locking portions and a projection portion 8*d* being a rotation regulating portion are formed on the outer periphery of the larger diameter portion 8–1 of the spring pressing member 8. Moreover, the compression spring 7 is disposed around the outer periphery of a guide bar 8*e* being the smaller diameter portion of the spring pressing member 8. The upper end portion of the compression spring 7 touches the stepped portion, where is the abutting portion of the smaller diameter portion and the larger diameter portion, of the spring pressing member 8. The projection portions 8*a* to 8*c* formed on the outer periphery of the larger diameter portion are disposed at the same height in the axial direction (or the compression direction of the compression spring 7), and only the projection portion 8*d* is disposed at a position higher than other projection portions 8*a* to 8*c*.

As shown in (1) of FIG. 2B, the compression spring 7 is inserted into the pressuring portion 5*a* of the pressuring force transmitting member 5 through the hole 31*a* of the flange portion 31A. Next, as shown in (2) of FIG. 2B, the guide bar 8*e* of the spring pressing member 8 is inserted into the inner diameter portion of the compression spring 7 to be pressed downwards.

The plural concavity portions 31*a*-1 to 31*a*-4 are formed in accordance with the phase angles of the projection portions 8*a* to 8*d* formed on the outer periphery of the spring pressing member 8. As shown in (3) of FIG. 2B, all of the projection portions 8*a* to 8*d* can pass through the hole 31*a* of the pressure roller supporting member 31 by the pushing of the spring pressing member 8 into the hole 31*a* only at a certain relative angle (or a specific phase angle) between the plural projection portions 8*a* to 8*d* and the plural concavity portions 31*a*-1 to 31*a*-4 being recessed portions, at which the former and the latter just meet to each other. After the spring pressing member 8 has passed through the hole 31*a*, as shown in (4) of FIG. 2A, the spring pressing member 8 cannot pass through the hole 31*a* with the projection portions 8*a*, 8*b* and 8*c* abutting against the flange member 31A between the concavity portions 31*a*-1 to 31*a*-4 by the rotation of the spring pressing member 8. Then, the spring force of the compression spring 7 can be supported. In the case, only the projection portion 8*d* is fitted to an adjoining concavity portion 31*a*-3 at a position shifted from the specific phase angle by a predetermined angle, and the spring pressing member 8 moves upwards by a little quantity. However, the other projection portions 8*a* to 8*c* touch the flange portion 31A at the positions between the concavity portions 31*a*-1 to 31*a*-4. Then, the upward movement of the spring pressing member 8 is regulated. Moreover, as shown in (5) of FIG. 2B, the rotation of the spring pressing member 8 is also regulated in the state such that the projection portion 8*d* is fitted to the concavity portion 31*a*-3 as shown in (5) of FIG. 2B. That is, the projection portion 8*d* is a projection for preventing the rotation of the spring pressing member 8, and performs the role of the function of preventing the rotation of the spring pressing member 8 to the hole 31*a*.

Hereinafter, the advantages of the present embodiment are described.

Figure 8A:
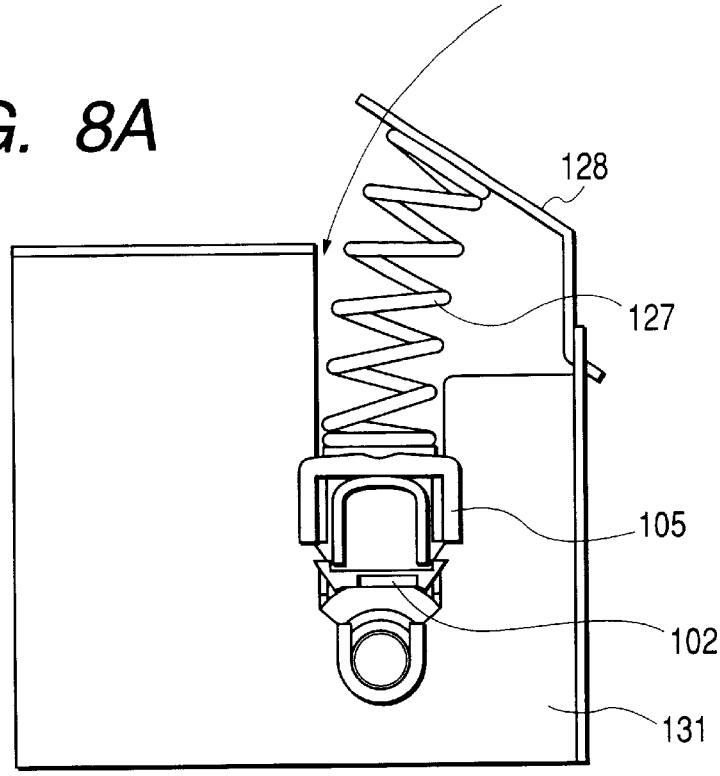
FIG. 8A and FIG. 8B are views showing assembling methods of the spring pressing portion of the heat fixing apparatus of FIG. 7.
Figure 8B:
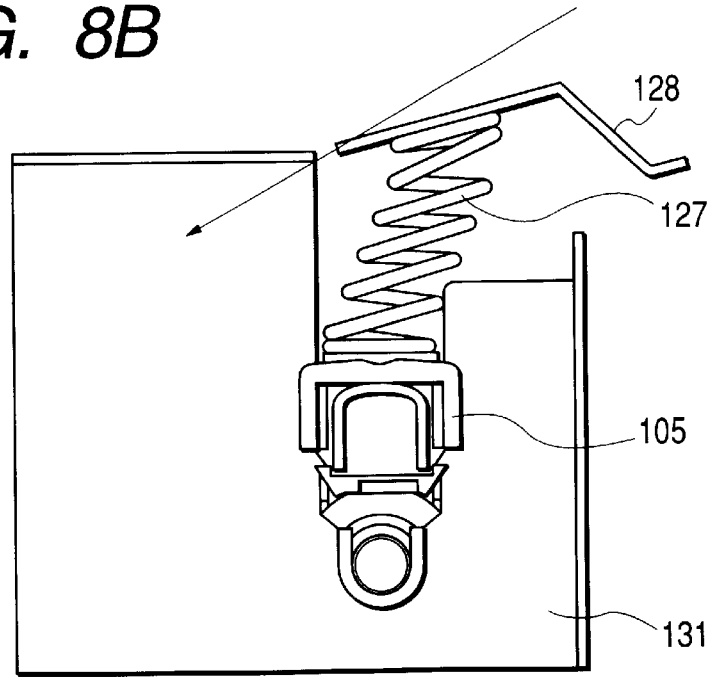
Figure 9A:
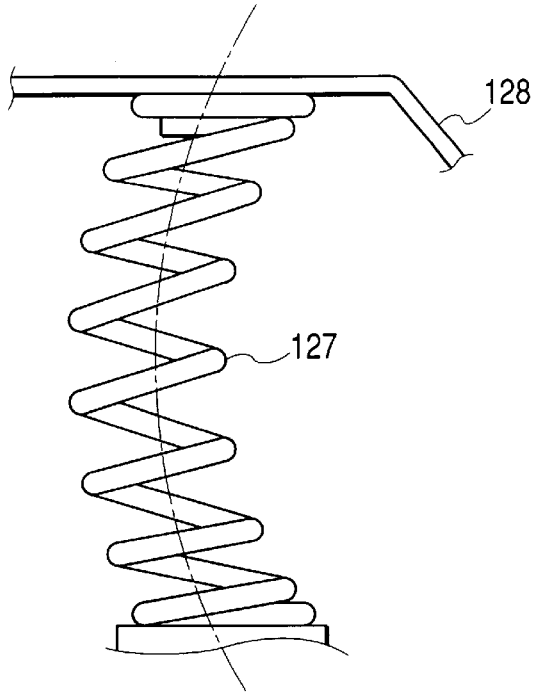
FIG. 9A and FIG. 9B are vies showing the states of the compression spring of the heat fixing apparatus of FIG. 7 at the assembling thereof.
Figure 9B:
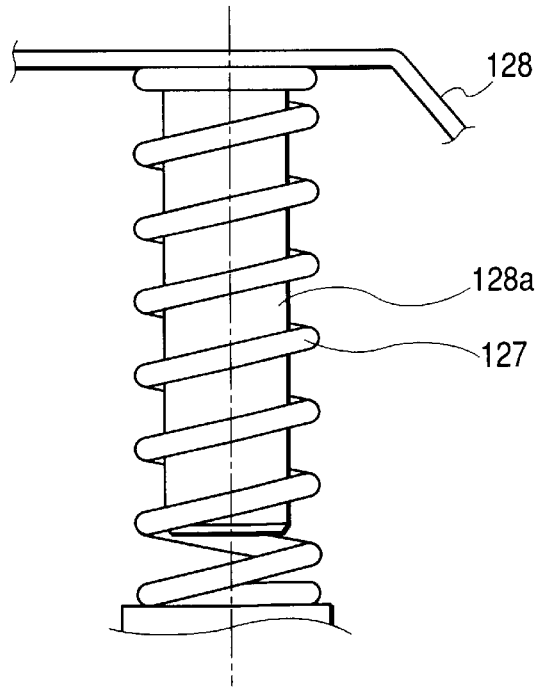

A first advantage is the improvement of the assembling efficiency of the heat fixing apparatus. By employing the configuration of the present embodiment, the present embodiment can assemble the compression spring 7 and the spring pressing member 8 straightly without bending the compression spring 7 as shown in FIG. 8A and FIG. 8B. Consequently, even if the load of the compression spring 7 is large, or even if the free length thereof is long, good assembling efficiency can be obtained.

A second advantage of the present embodiment is the capability of the spring constant of the compression spring 7 to be small. As described above, the configuration of the present embodiment makes it possible to incorporate the compression spring 7 and the spring pressing member 8 straightly without bending the compression spring 7 as shown in FIGS. 8*a* and 8*b*. Consequently, even if the compression spring 7 is a spring having the comparative large rate of the free length to the winding diameter, the compression spring 7 is hard to bend in the assembling process thereof. Thereby, the assembling efficiency thereof does not worsen. As a result, the spring constant thereof can be set to be smaller than that of the related art.

Moreover, because the compression spring 7 and the spring pressing member 8 is incorporates straightly from a just above portion without the compression spring 7 being bent, it becomes possible to provide the guide bar 8*e* in the inside of the compression spring 7. By the provision of the guide bar 8*e*, the loss of the spring force owing to the buckling is hard to produce even if the rate of the free length to the winding diameter is made large. It thereby becomes possible to set the spring constant relatively small. Consequently, a stable pressurizing force can be obtained, and the fixing property of the heat fixing apparatus can be stabilized.

A third advantage is the capability of the resinification of the spring pressing member 8. If the hole 31*a* of the pressure roller supporting member 31 and the winding diameter of the compression spring 7 are designed to be in sizes such that the difference between both of them are as small as possible, as shown in (5) of FIG. 2B, the point A of action of the compression spring 7 in the spring pressing member 8 can be set at a position extremely near to a position of the point B of action of the flange portion 31A of the pressure roller supporting member 31 in the spring pressing member 8 when being seen from the direction C of the acting forces.

As a result, if the size D (the distance from the stepped portion of the spring pressing member 8 to the upper end potion of the projection portions 8*a* to 8*c*) shown in (5) of FIG. 2B is set to be sufficiently large, the acting force of the compression spring 7 acts the spring pressing member 8 not as the bending stress in the direction E shown in (5) of FIG.

2B, but as the compressive stress in the direction F in (5) of FIG. 2B. Consequently, not only a metal but also a resin can have necessary rigidity.

Moreover, if the spring pressing member 8 is made from a metal, the bar shape is difficult to form. However, if the spring pressing member 8 is made from a resin as the present embodiment, the guide bar 8*e* is easy to mold.

As described above, according to the present embodiment, a high quality heat fixing apparatus, which has a simple and cheap configuration and is superior in the assembling property at the time of manufacturing, and the mass production property of which is stable, can be realized.

Figure 3:
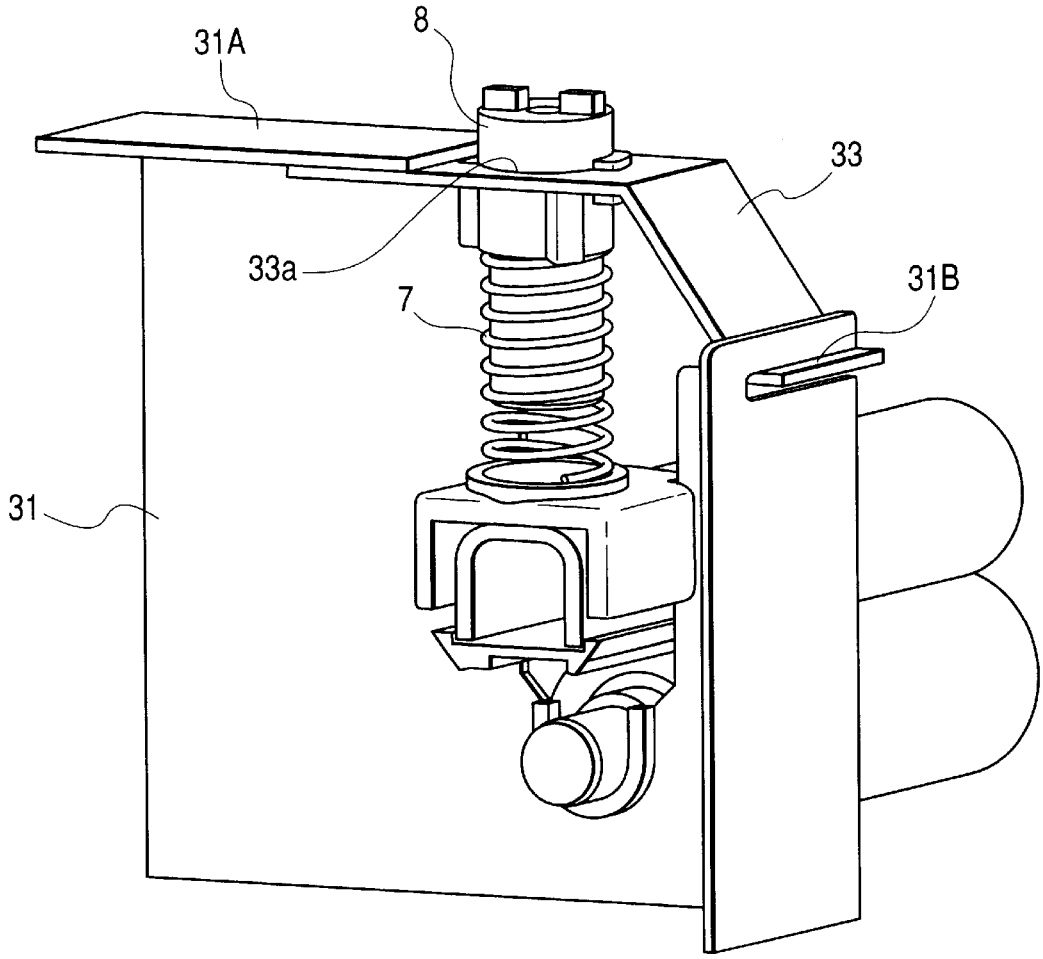
FIG. 3 is a perspective view showing the pressurizing portion of an image heating apparatus being a modified example of the first embodiment.

Moreover, the present embodiment exemplifies the case where the hole 31*a*, through which the compression spring 7 and the spring pressing member 8 are incorporated, is formed in the pressure roller supporting member 31 and the spring pressing member 8 is supported by the pressure roller supporting member 31. However, the configuration shown in FIG. 3 achieves the similar advantages. That is, in the configuration, a hole 33*a*, through which the compression spring 7 and the spring supporting member 8 are incorporated, is formed in a spring pressing supporting member 33, which is a supporting portion fixed to the pressure roller supporting member 31 as a separated body, and the spring pressing member 8 is supported by the spring pressing supporting member 33. Incidentally, one end side of the spring pressing supporting member 33 is fitted in a fitting groove 31B of the pressure roller supporting member 31. The other end side of the spring pressing supporting member 33 is touched to the under surface of the flange portion 31A at the upper portion of the pressure roller supporting member 31. In such a state, the compression spring 7 and the spring pressing member 8 are mounted in the spring pressing supporting member 33 through the procedure shown in FIG. 2B.

Figure 4:
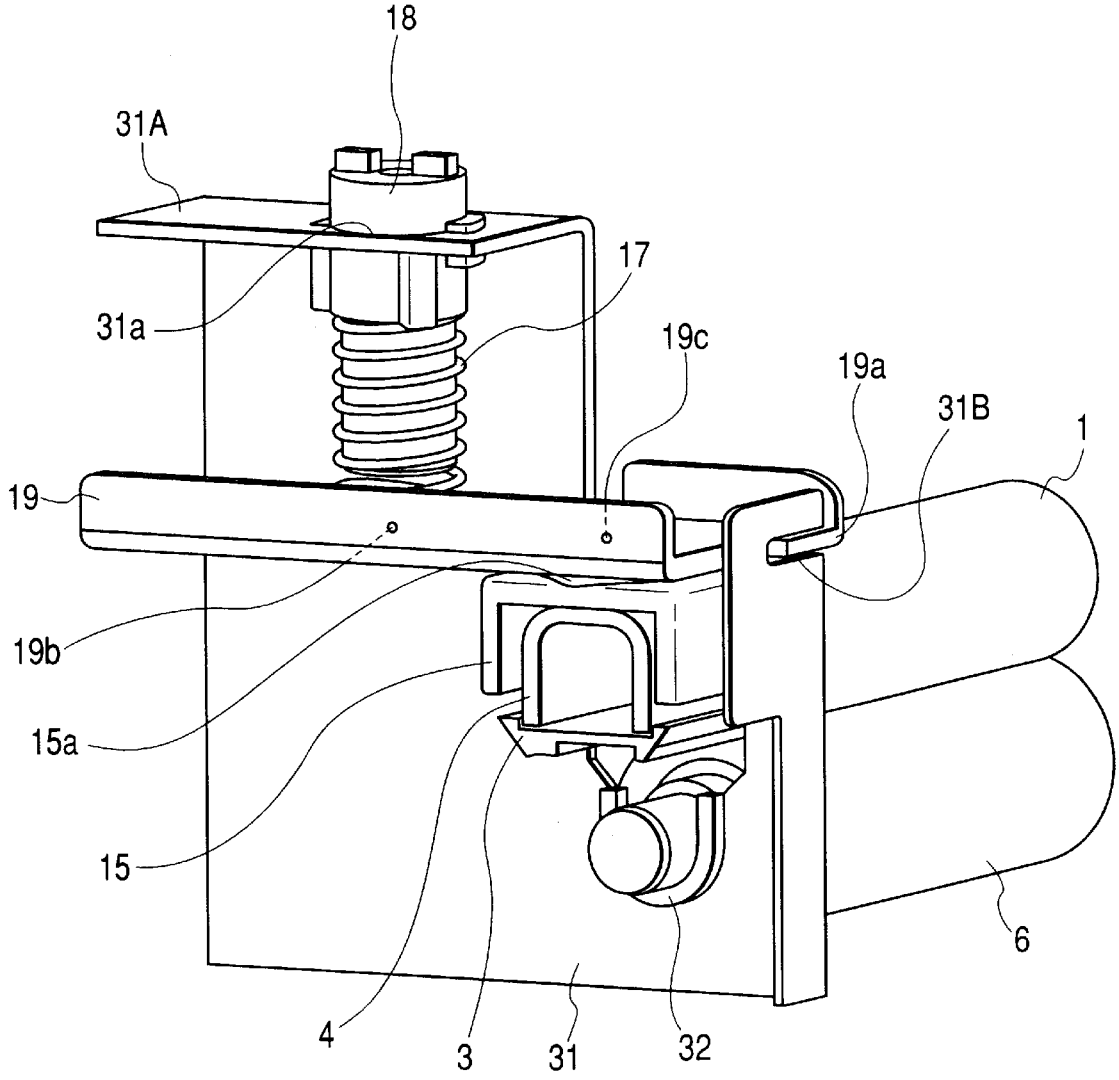
FIG. 4 is a perspective view showing the pressurizing portion of a heat fixing apparatus of a second embodiment of the present invention.

FIG. 4 shows a second embodiment of the present invention. FIG. 4 is a perspective view showing the pressurizing portion of a heat fixing apparatus.

In FIG. 4, the reference numeral 1 designates the heat-proof film; the reference numeral 3 designates the heater holding member; the reference numeral 4 designates the metal stay; a reference numeral 15 designates a pressurizing force transmitting member; a reference numeral 15*a* designates a pressuring portion; the reference numeral 6 designates the pressure roller; a reference numeral 17 designates a compression spring; a reference numeral 18 designates a spring pressing member made by resin molding; a reference numeral 19 designates a pressurizing plate; the reference numeral 31 designates the pressure roller supporting member; and the reference numeral 32 designates the pressure roller bearing.

In the embodiment shown in FIG. 1, the spring pressing member 8 is disposed at the upper position of the pressure roller 6. In the present embodiment, the spring pressing member 18 is disposed at a position shifted from the position just above the pressure roller 6. That is, the compression spring 17 is disposed at the position staying off the line connecting the heater 2 and the pressure roller 6. Incidentally, the configuration in which the spring pressing member 18 is attached to the hole 31*a* formed in the flange portion 31A of the pressure roller supporting member 31 is the same as that in the first embodiment.

And, in the present embodiment, the pressuring plate 19 being a lever member is placed on the pressuring portion 15*a* of the top surface of the pressurizing force transmitting member 15. One end side of the pressuring plate 19 is fitted to a fitting groove 31B of the pressure roller supporting member 31. Thereby, the pressuring plate 19 is made to be rotatable around the fitted end side. The lower end of the compression spring 17 is touched to the free end side of the pressuring plate 19.

As shown in FIG. 4, in the present embodiment, the pressurizing plate 19 is operated as a "lever": the fulcrum 19*a* of the "lever" is a fitting portion of the pressurizing plate 19 to the fitting groove 31B; the point 19*b*, where a force is applied, of the "lever" is a position where the lower end of the compression spring 17 touch; and the point 19*c* of the action of the "lever" is a position where the pressuring portion 15*a* of the pressurizing force transmitting member 15 touch. The pressurizing plate 19 is energized by the compression spring 17. The pressuring portion 15*a* of the pressuring force transmitting member 15 is pressurized through the pressurizing plate 19. Then, the heater 2 can be pressed to the pressure roller 6 with the metal stay 4 and the heater holding member 3 being put between the pressurizing plate 19 and the heater 2.

By the use of the pressurizing plate 19 as a "lever", the load of the compression spring 17 can be decreased according to the lever ratio even on the supposition that the pressuring force at the pressuring portion is made to be constant.

Moreover, in the present embodiment, the compression spring 17 is not needed to be disposed on the point just above the pressuring force transmitting member 15. The function of pressing the upper end of the compression spring 17 can easily be formed in the pressure roller supporting member 31 while the capability of the incorporation of the pressurizing force transmitting member 15 from the upper part is kept.

Moreover, the load of the compression spring 17 is lightened according to the lever ratio. Consequently, the following advantages are obtained. That is, the assembling work of the heat fixing apparatus becomes very easy. On the other hand, the rigidity of the pressure roller supporting member 31 at the peripheral portions where the spring pressing member 18 is attached is not needed to be strengthened excessively.

As described above, the heat fixing apparatus of the present embodiment utilizing the pressuring plate 19 as a "lever" can attain three advantages of the improvement of the assembling property, the decrease of the spring constant of the compression spring 17, and the resinification of the spring pressing member 18 similarly to the first embodiment.

Consequently, according to the present embodiment, a high quality heat fixing apparatus, which has a simple and cheap configuration and is superior in the assembling property at the time of manufacturing, and the mass production property of which is stable, can be realized.

As described above, according to the present invention, three advantages can be obtained. That is, the improvement of the assembling property, the decrease of the spring constant of the compression spring, and the resinification of the spring pressing member can be realized. As a result, a high quality image heating apparatus, which has a simple and cheap configuration and is superior in the assembling property at the time of manufacturing, and the mass production property of which is stable, can be realized.

Although the embodiments of the present invention are described in the above, the present invention is not limited to the embodiments. Any modification can be made in the scope of the present invention.

What is claimed is:

1. An image heating apparatus comprising:

a heater;

a film sliding on said heater;

a roller forming a nip with said heater with said film positioned between said roller and said heater, said nip nipping and conveying a recording material bearing an image thereon with the image on the recording material being heated by heat from said heater through said film;

an elastic member for pressing said heater against said roller;

a pressing member for pressing an end portion of said elastic member on a side thereof opposed to a side of said heater; and a supporting portion for supporting said pressing member, said supporting portion including an opening portion through which said elastic member can pass, wherein said pressing member includes a lock portion for regulating a position of said pressing member in a pressing direction of said elastic member, and wherein said pressing member is allowed to pass through said opening portion in a state of being at a specific phase angle, and is prevented from coming out from said opening portion by being shifted in angle from the specific phase angle after passing through said opening portion.

2. An image heating apparatus according to claim 1, said apparatus further comprising a roller supporting member for supporting said roller, wherein said supporting portion is integrally formed with said roller supporting member.

3. An image heating apparatus according to claim 1, said apparatus further comprising a roller supporting member for supporting said roller, wherein said supporting portion is formed to be a separated body from said roller supporting member.

4. An image heating apparatus according to claim 1, wherein said elastic member is disposed on a line connecting said heater with said roller.

5. An image heating apparatus according to claim 1, wherein said elastic member is disposed at a position located off a line connecting said heater with said roller.

6. An image heating apparatus according to claim 5, said apparatus further comprising a lever member for transmitting a pressing force produced by said elastic member to said heater.

7. An image heating apparatus according to claim 6, said apparatus further comprising a roller supporting member for supporting said roller, wherein said lever member fits to said roller supporting member at a fitting portion, and transmits the pressing force produced by said elastic member to said heater by using the fitting portion as a fulcrum.

8. An image heating apparatus according to claim 1, wherein said elastic member is a coil-shaped spring.

9. An image heating apparatus according to claim 8, wherein said pressing member includes a larger diameter portion and a smaller diameter portion, said smaller diameter portion being inserted into an inside of said spring.

10. An image heating apparatus according to claim 1, wherein said pressing member includes a rotation regulation portion for regulating a rotation of said pressing member at a position shifted from said specific phase angle by a predetermined angle.

11. An image heating apparatus according to claim 10, wherein said lock portion and said rotation regulation portion are projection portions formed on an outer periphery portion of said pressing member, a position of the projection portion of said rotation regulation portion being shifted from a position of the projection portion of said lock portion in the pressing direction of said elastic member, the projection portion of said rotation regulation portion fitting to a concavity portion of said opening portion where the projection portion of said lock portion can pass through at the position shifted from said specific phase angle by the predetermined angle.

12. An image heating apparatus according to claim 1, wherein said pressing member is made from a resin.

13. An image heating apparatus according to claim 1, said apparatus further comprising:

a holding member for holding said heater;

a stay provided at a position opposite to a heater side of said holding member; and a transmitting member for transmitting a pressure;

wherein a pressing force produced by said elastic member is applied to said heater through said transmitting member, said stay, and said holding member.

* * * * *

UNITED STATES PATENT AND TRADEMARK OFFICE

CERTIFICATE OF CORRECTION

PATENT NO. : 6,731,901 B2
DATED : May 4, 2004
INVENTOR(S) : Hitoshi Nishitani et al.

It is certified that error appears in the above-identified patent and that said Letters Patent is hereby corrected as shown below:

Title page,
Item [56], References Cited, FOREIGN PATENT DOCUMENTS,

| | | |
|---|---|---|
| "8328406 | | -- 8-328406 |
| 09212019 | should read | 9-212019 |
| 10171276" | | 10-171276 --. |

Column 1,
Line 29, "An" should read -- an --.
Line 66, "inserted" should read -- be inserted --.

Column 4,
Line 19, "vies" should read -- views --.

Column 6,
Line 19, "not" should read -- non- --.

Column 10,
Line 14, "touch." should read -- touches. --.

Signed and Sealed this

Tenth Day of August, 2004

JON W. DUDAS
*Acting Director of the United States Patent and Trademark Office*